US008276574B1

(12) United States Patent
Wilson

(10) Patent No.: US 8,276,574 B1
(45) Date of Patent: Oct. 2, 2012

(54) COMPOUND ARCHERY BOW

(75) Inventor: Dennis Anthony Wilson, Kathleen, GA (US)

(73) Assignee: Rex Darlington, Hale, MI (US)

( * ) Notice: Subject to any disclaimer, the term of this patent is extended or adjusted under 35 U.S.C. 154(b) by 56 days.

(21) Appl. No.: 12/846,217

(22) Filed: Jul. 29, 2010

Related U.S. Application Data

(63) Continuation of application No. 12/290,750, filed on Nov. 3, 2008, now Pat. No. 7,997,259.

(60) Provisional application No. 61/014,834, filed on Dec. 19, 2007.

(51) Int. Cl.
*F41B 5/10* (2006.01)

(52) U.S. Cl. ..... 124/25.6; 124/900

(58) Field of Classification Search ..... 124/25.6, 124/900

See application file for complete search history.

(56) References Cited

U.S. PATENT DOCUMENTS

| | | | | | |
|---|---|---|---|---|---|
| 3,990,425 | A | * | 11/1976 | Ketchum | 124/25.6 |
| 4,060,066 | A | * | 11/1977 | Kudlacek | 124/25.6 |
| 4,300,521 | A | * | 11/1981 | Schmitt | 124/25.6 |
| 4,333,443 | A | * | 6/1982 | Roelle | 124/25.6 |
| 4,368,718 | A | * | 1/1983 | Simonds et al. | 124/25.6 |
| 4,401,097 | A | * | 8/1983 | Simonds et al. | 124/25.6 |
| 4,438,753 | A | * | 3/1984 | Simonds | 124/25.6 |
| 4,440,142 | A | * | 4/1984 | Simonds | 124/25.6 |
| 4,478,203 | A | * | 10/1984 | Hayes | 124/25.6 |
| 4,561,413 | A | * | 12/1985 | Jennings | 124/25.6 |
| 4,774,927 | A | * | 10/1988 | Larson | 124/25.6 |
| 4,926,833 | A | * | 5/1990 | Darlington | 124/23.1 |
| 4,971,020 | A | * | 11/1990 | Soderstrom et al. | 124/23.1 |
| 5,040,520 | A | * | 8/1991 | Nurney | 124/25.6 |
| 5,368,006 | A | * | 11/1994 | McPherson | 124/25.6 |
| 5,505,185 | A | * | 4/1996 | Miller | 124/25.6 |
| 5,975,067 | A | * | 11/1999 | Strother | 124/25.6 |
| 6,082,346 | A | * | 7/2000 | Andrews et al. | 124/25.6 |
| 6,082,347 | A | * | 7/2000 | Darlington | 124/25.6 |
| 6,237,582 | B1 | * | 5/2001 | McPherson | 124/25.6 |
| 6,247,466 | B1 | * | 6/2001 | McPherson | 124/25.6 |
| 6,250,293 | B1 | * | 6/2001 | Andrews | 124/25.6 |
| RE37,544 | E | * | 2/2002 | Darlington | 124/25.6 |
| 6,360,735 | B1 | * | 3/2002 | Larson et al. | 124/25.6 |

(Continued)

*Primary Examiner* — John Ricci
(74) *Attorney, Agent, or Firm* — Reising Ethington PC

(57) ABSTRACT

A compound archery bow includes a handle having projecting limbs, and first and second pulleys mounted on the limbs for rotation around respective axes. At least a first of the pulleys includes a flat base with a bowstring let-out groove on the base and a bowstring anchor adjacent to the bowstring let-out groove. A draw module is disposed on the base, a cable groove extends along the draw module, and first and second cable anchors are disposed on the base adjacent to respective ends of the cable groove. The cable groove on the draw module is continuous in a plane perpendicular to the axis of the first pulley. A bow cable arrangement includes a bowstring cable extending from the bowstring anchor on the first pulley around the bowstring let-out groove and then toward the second pulley. A first cable extends from the first anchor on the first pulley through a portion of the cable groove on the module and then toward the second pulley. A second cable extends from the second anchor toward the second pulley. Draw of the bowstring cable away from the bow handle lets out bowstring cable from the bowstring cable groove on the first pulley and rotates the first pulley around its axis, lets out the first cable from the groove on the module and takes up the second cable into the groove on the module including a portion of such groove previously occupied by the first cable.

18 Claims, 12 Drawing Sheets

U.S. PATENT DOCUMENTS

| | | | | |
|---|---|---|---|---|
| 6,443,139 | B1 * | 9/2002 | McPherson | 124/25.6 |
| 6,446,619 | B1 * | 9/2002 | McPherson | 124/25.6 |
| 6,688,295 | B1 * | 2/2004 | Miller | 124/25.6 |
| 6,691,692 | B1 * | 2/2004 | Adkins | 124/25.6 |
| 6,718,963 | B1 * | 4/2004 | Wheeler | 124/25.6 |
| D510,974 | S * | 10/2005 | Gallops, Jr. | D22/107 |
| 6,990,970 | B1 * | 1/2006 | Darlington | 124/25.6 |
| 7,082,937 | B1 * | 8/2006 | Land | 124/25.6 |
| 7,305,979 | B1 * | 12/2007 | Yehle | 124/25.6 |
| 7,441,555 | B1 * | 10/2008 | Larson | 124/25.6 |
| 2004/0003806 | A1 * | 1/2004 | Blahnik | 124/25.6 |
| 2009/0188482 | A1 | 7/2009 | Strother | |
| 2009/0255520 | A1 | 10/2009 | Strother | |
| 2009/0288650 | A1 | 11/2009 | Batdor | |
| 2009/0320816 | A1 | 12/2009 | Strother | |
| 2010/0051005 | A1 | 3/2010 | Wilson | |

* cited by examiner

COMPOUND ARCHERY BOW

This application is a continuation of application Ser. No. 12/290,750 filed Nov. 3, 2008, and claims priority from application Ser. No. 61/014,834 filed Dec. 19, 2007.

The present disclosure is directed to compound archery bows having pulleys at the ends of the bow limbs to control the force/draw characteristics of the bow, and more particularly to both single-cam bows having a power let-off cam mounted on the end of one of the bow limbs and dual-cam bows having power let-off cams mounted on the ends of both bow limbs.

BACKGROUND AND SUMMARY OF THE DISCLOSURE

Single-cam and dual-cam compound archery bows have a power cam mounted on one or both ends of the bow limbs to control the draw force on the bowstring and the bending of the limbs as the bowstring is drawn. In single-cam bows, there is a power cam on the end of one bow limb, and a wheel on the end of the other bow limb to facilitate control or time take-up of a power cable at the power cam and let-out of the bowstring and control cables at the power cam as the bow is drawn. In dual-cam bows, power cams are mounted on the ends of both limbs, with each including groove segments to control let-out of the bowstring cable at the opposing cam.

A general object of the present disclosure is to provide a compound archery bow that achieves enhanced power and arrow speed as compared with compound archery bows of the prior art and/or to reduce or eliminate timing issues between cams on dual cam bows.

The present disclosure embodies a number of aspects that can be implemented separately from or in combination with each other.

A compound archery bow, in accordance with one aspect of the present disclosure, includes a handle having projecting limbs, and first and second pulleys mounted on the limbs for rotation around respective axes. At least a first of the pulleys includes a flat base with a bowstring let-out groove on the base and a bowstring anchor adjacent to the bowstring let-out groove. A draw module is disposed on the base, a cable groove extends along the draw module, and first and second cable anchors are disposed on the base adjacent to respective ends of the cable groove. The cable groove on the draw module is continuous in a plane perpendicular to the axis of the first pulley. A bow cable arrangement includes a bowstring cable extending from the bowstring anchor on the first pulley around the bowstring let-out groove and then toward the second pulley. A first cable extends from the first anchor on the first pulley through a portion of the cable groove on the module and then toward the second pulley. A second cable extends from the second anchor toward the second pulley. Draw of the bowstring cable away from the bow handle lets out bowstring cable from the bowstring cable groove on the first pulley and rotates the first pulley around its axis, lets out the first cable from the groove on the module and takes up the second cable into the groove on the module including a portion of such groove previously occupied by the first cable.

BRIEF DESCRIPTION OF THE DRAWINGS

The disclosure, together with additional objects, features, advantages and aspects thereof, will best be understood from the following description, the appended claims and the accompanying drawings, in which:

DETAILED DESCRIPTION OF PREFERRED EMBODIMENTS

Figure 1:
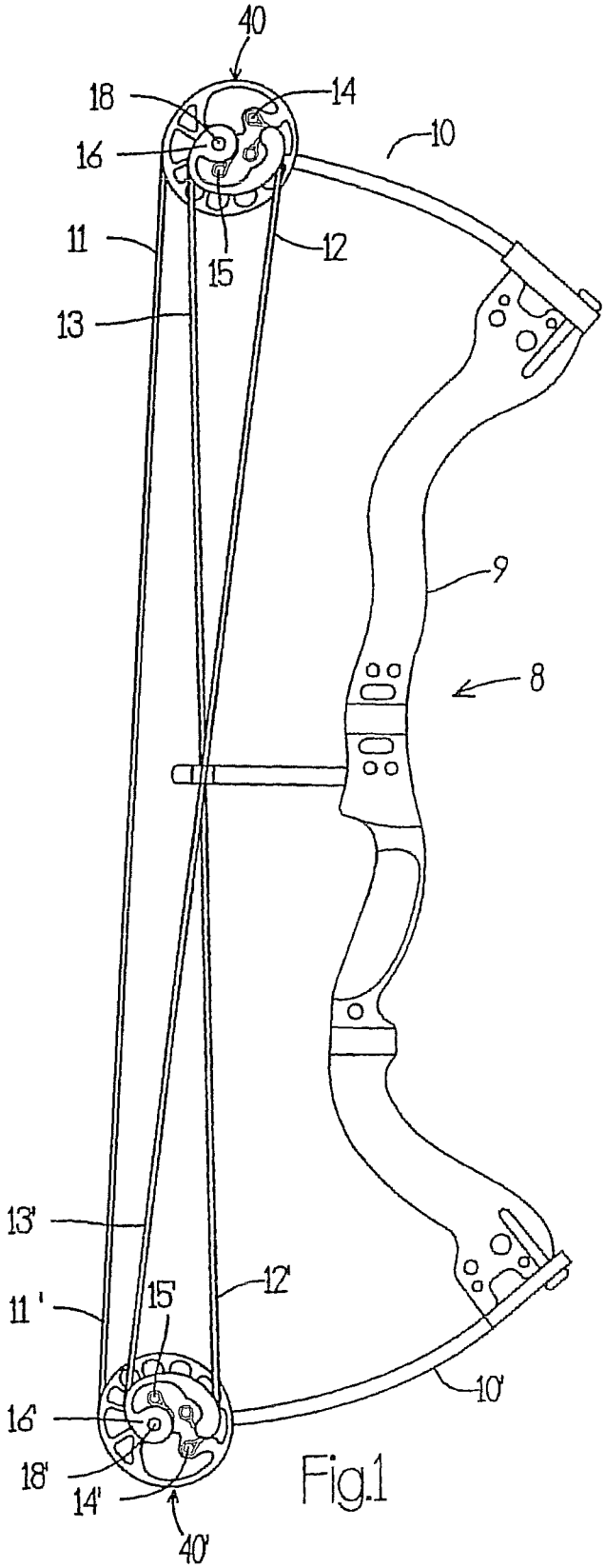
FIG. 1 is an elevational view of a compound archery bow in accordance with an exemplary first embodiment of the present disclosure.

FIGS. 1, 2, 2A and 6 illustrate a dual-cam compound archery bow 8 in accordance with one exemplary embodiment of the present disclosure as comprising a handle 9 of aluminum or other relatively rigid construction having spaced risers with bow-mounting surfaces at each end. A pair of flexible resilient limbs 10,10' of fiber-reinforced resin or other suitable resilient construction are mounted on the respective handle risers and project away from handle 9. An upper pulley 40 is mounted on limb 10 for rotation around an axle 18, and a lower pulley 40' is mounted on an end of limb 10' for rotation around an axle 18'. Bow 8 in FIGS. 1-2A and 6 is a dual-cam bow in which pulleys 40,40' are similar in functions and preferably are near mirror images of each other. (Upper pulley 40 can be slightly larger than lower pulley 40' to compensate for the arrow rest not being at the true center of the bow. Some pulleys also can be made non-identical in areas that are non-functional to create a desired difference in appearance.)

Pulley 40 includes a flat base 42 having a bowstring let-out groove 23 extending around at least a portion of the periphery of the base in a plane perpendicular to the axis of axle 18. A bowstring cable end 11 extends from a bowstring anchor 17 on base 42 around groove 23 and toward pulley 40' at the opposing end of the bow, at which bowstring cable end 11' extends through groove 23 of base 42' to an anchor 17'. A draw module 16 is disposed on base 42. Draw module 16 in this embodiment preferably is permanently mounted on base 42, such as by being formed in one piece with the base. Draw module 16 has a groove 22 that extends around the module and around the axis of rotation of pulley 40. Groove 22 is continuous in a plane perpendicular to the axis of axle 18. Pulley 40' is a mirror image or near-mirror image of pulley 40, and corresponding elements of pulley 40' are indicated with the same reference numeral and a prime symbol.

A first cable end 13 extends from an anchor 15 on base 42 around a portion of groove 22 on module 16 and then toward pulley 40', at which the opposing end 12' is secured to an anchor 14', preferably after passing around a portion of groove 22 on module 16'. A second cable end 12 extends from an anchor 14 on pulley 40, preferably through at least a portion of groove 22 on module 16, to pulley 40', at which the opposing cable end 13' extends through a portion of groove 22 on module 16' to an anchor 15'. Thus, as bowstring cable 11,11' is pulled away from handle 9 (to the left in FIGS. 1 and 2), the bowstring cable unwraps from bowstring let-out groove 23 on base 42 of pulley 40 and base 42' of pulley 40'. Pulleys 40,40' thereby are rotated in opposite directions by draw of bowstring cable 11,11', letting out portions of cable ends 13,13' and taking up portions of cable ends 12,12'. The portions of cable ends 12,12' taken up into module grooves 22 occupy at least some portion of the module grooves previously occupied by let-out cable ends 13,13'. That is, cable grooves 22 on modules 16,16' function both as let-out grooves for cable ends 13,13' and as take-up grooves for cable ends 12,12' Thus, with the bowstring fully drawn in FIG. 1A in this example, cable end 13 is substantially or entirely unwrapped from module 16 and cable end 12 is wrapped substantially entirely around the module.

The opposing pulleys thus are slaved together and eliminate any cam-to-cam timing issues. Cable ends 13,13' are let out at a significantly lower rate than take-up of cable ends 12,12', which results in maximum limb compression of the opposing bow limbs. This helps achieve a high level of stored bow energy, dynamic efficiency and kinetic energy, achieving improved arrow speed. Stops 19, 19' on pulleys 40, 40' abut the bow limbs to limit bow draw.

FIGS. 1A, 3-5 and 7-10B illustrate modified embodiments of the disclosure. In each embodiment, elements that correspond to elements previously discussed in connection with FIGS. 1-2A and 6 are identified by correspondingly identical reference numerals with a letter suffix.

Figure 3:
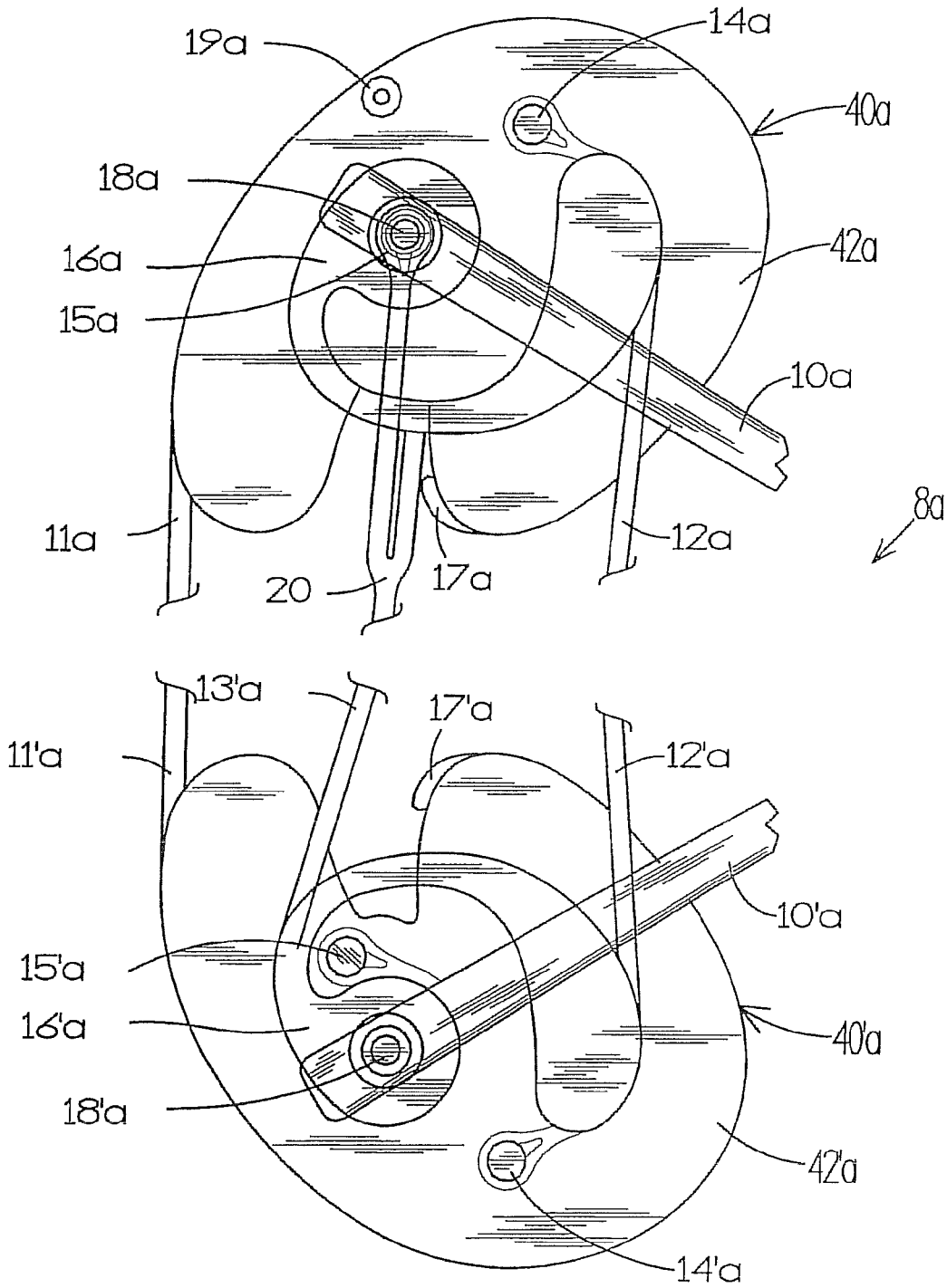
FIG. 3 is a fragmentary elevational view similar to those of FIG. 2 but illustrating a second embodiment of the disclosure.

In bow 8*a* of FIG. 3, the bow cable having lower end 12'*a* has its upper end 20 anchored at axle 18*a*. Thus, in this embodiment, the upper end 20 is not let out from the groove of module 16*a*. However, lower pulley 40'*a* operates as preciously described. Bowstring cable ends 11*a*, 11'*a* are secured to pulleys 40*a*, 40'*a* at anchors 17*a*, 17'*a*.

Figure 2A:
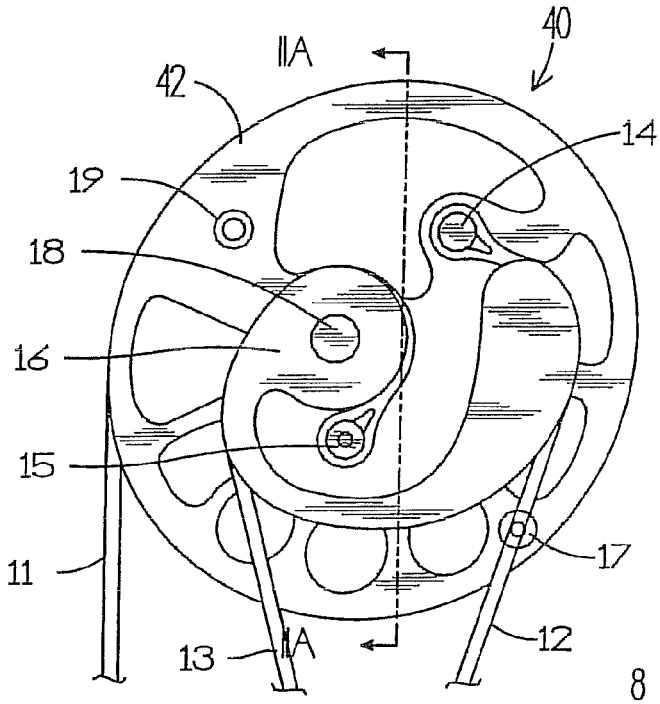
FIG. 2A is a sectional view taken substantially along the line 2A-2A of FIG. 2.
Figure 2A:
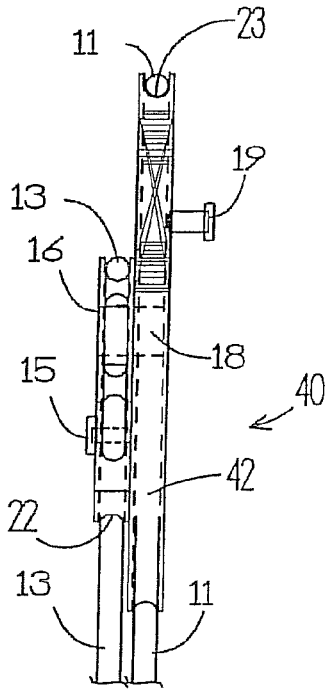
Figure 2:
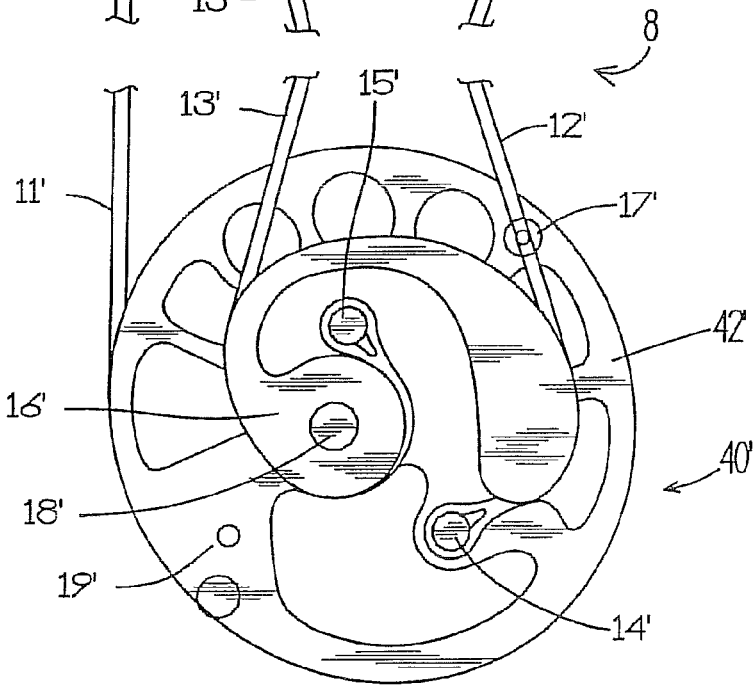
FIG. 2 is a fragmentary elevational view on an enlarged scale of the pulleys in the bow of FIG. 1.
Figure 4:
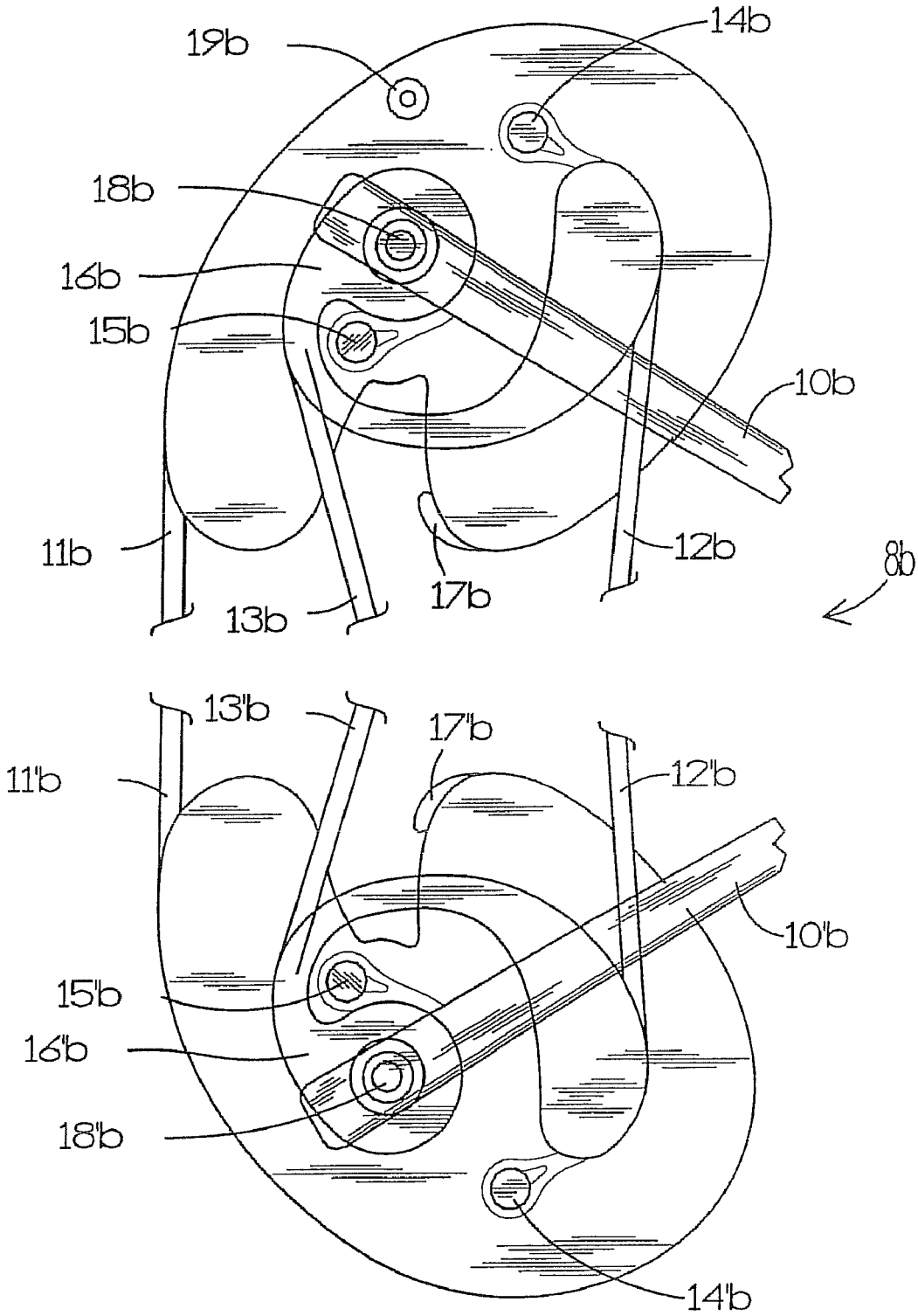
FIG. 4 is a fragmentary elevational view similar to those of FIGS. 2 and 3 but illustrating another embodiment of the disclosure.

Bow 8*b* of FIG. 4 is similar to bow 8 in FIG. 2 except for a different shape to the bowstring groove and different placement of bowstring anchors 17*b*, 17'*b*.

Figure 5:
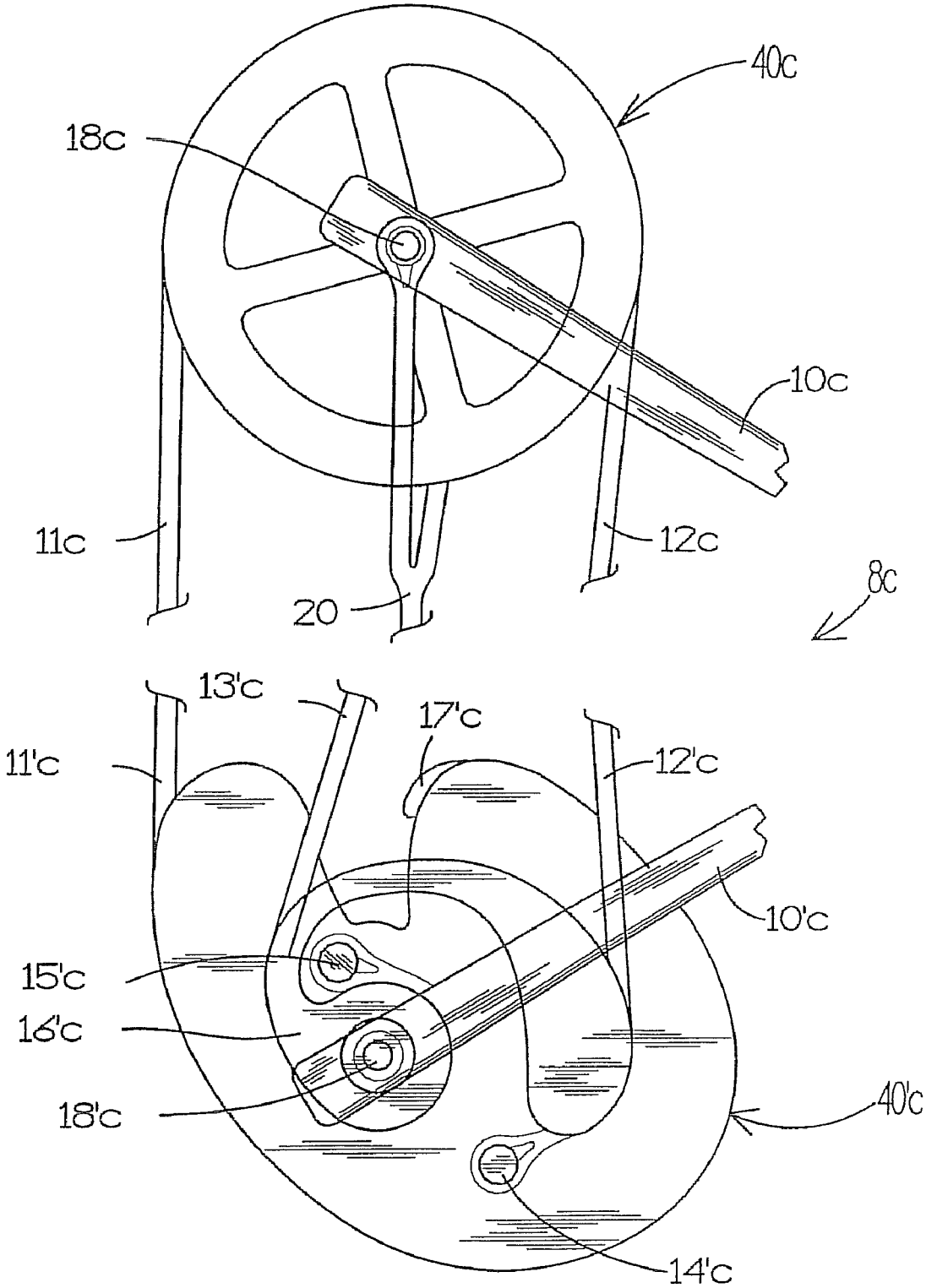
FIG. 5 is a fragmentary elevational view similar to those of FIGS. 2, 3 and 4 but illustrating a further embodiment of the disclosure.
Figure 6:
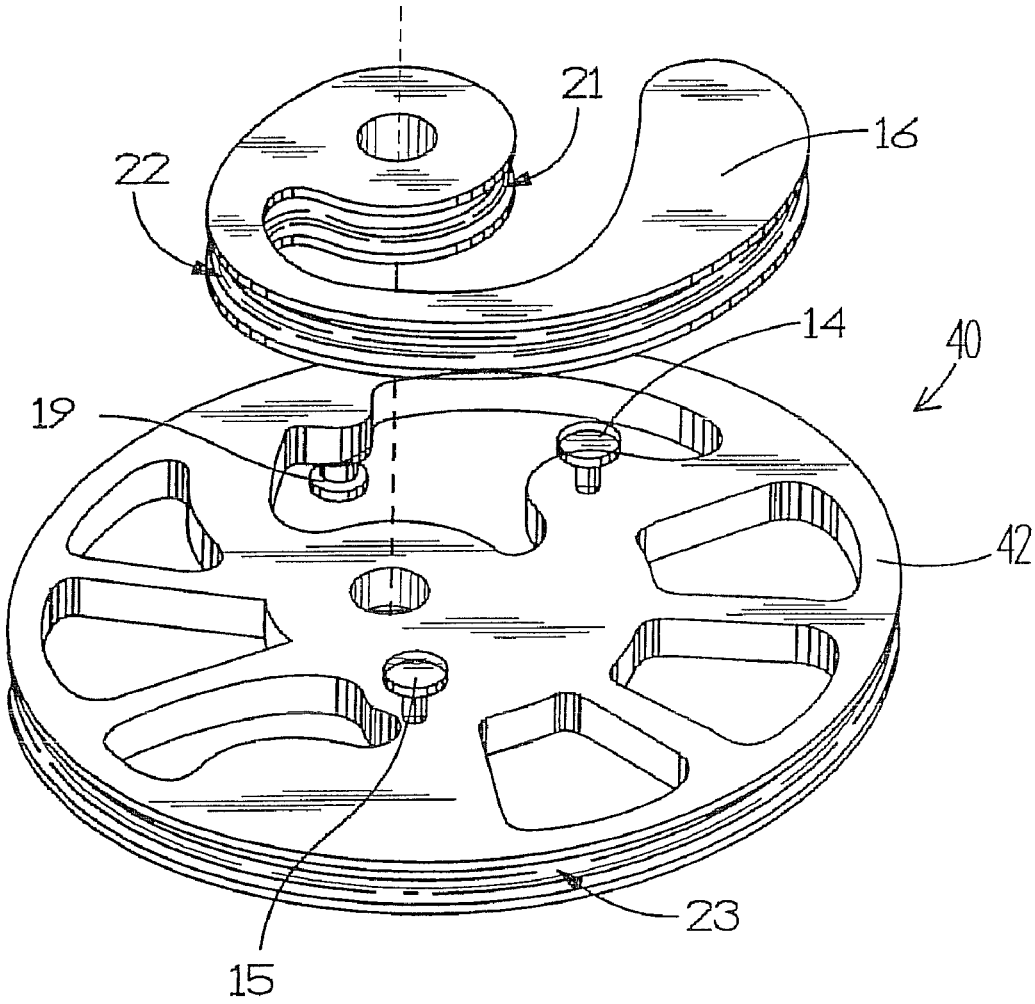
FIG. 6 is an exploded perspective view of the power cam in the embodiment of FIGS. 1-2A.

FIG. 5 illustrates an exemplary single cam bow 8*c* in accordance with the present disclosure, in which the upper pulley 40*c* is a wheel having a peripheral groove concentric with the axis of axle 18*c*. Lower pulley 40'*c* is the same as pulley 40'*a* in FIG. 3. Thus, in the embodiment of FIG. 5, the bowstring cable extends from end 11'*c* at pulley 40'*c* to end 11*c* at pulley 40*c*, around pulley 40*c* to cable end 12*c*, then to cable end 13'*c* around module 16'*c* to anchor 15'*c*. Cable end 12'*c* extends from anchor 14'*c*, preferably around a portion of the module groove, to cable end 20 anchored at axle 18*c*.

Figure 7:
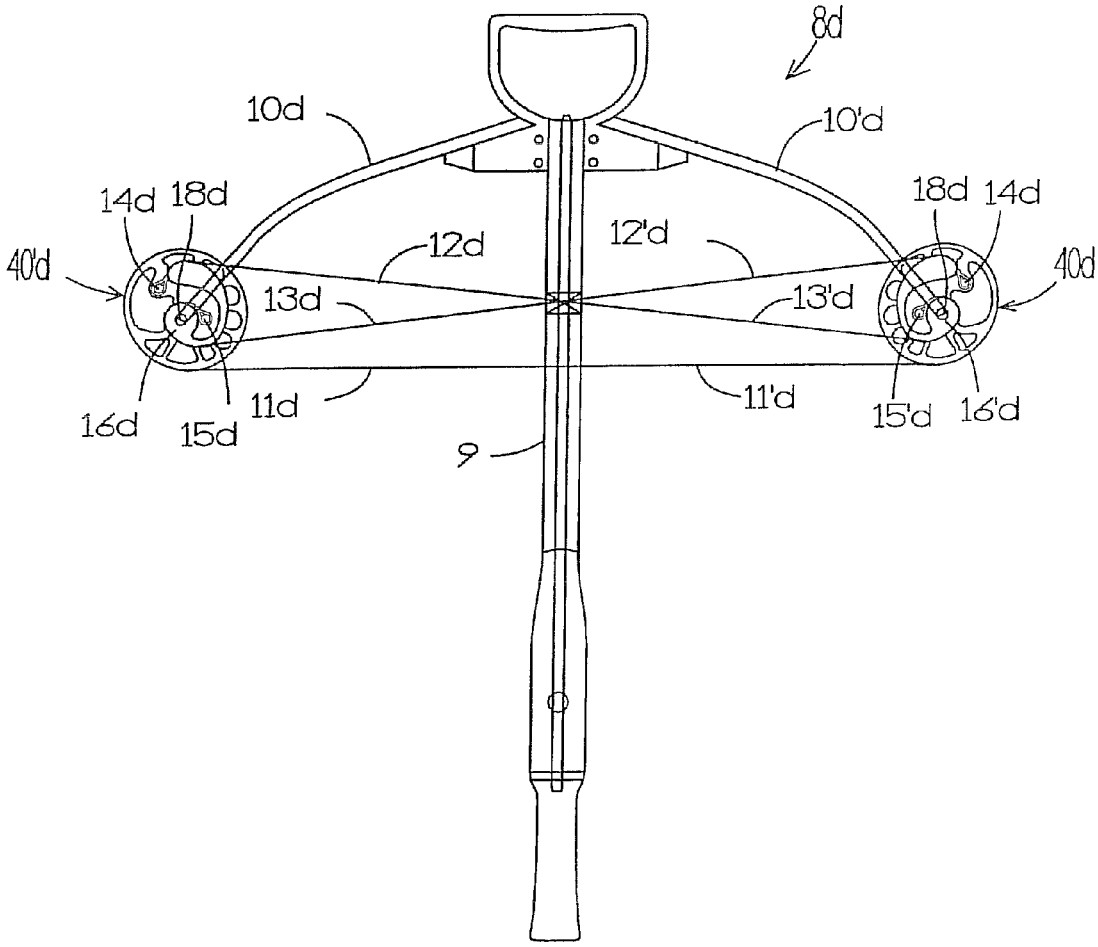
FIG. 7 is a top plan view of a crossbow that embodies the principles of the present disclosure.

FIG. 7 illustrates a crossbow 8*d* that employs pulleys 40*d*, 40'*d* similar to those discussed in detail above in connection with the embodiment of FIGS. 1-2A and 6.

Figure 8A:
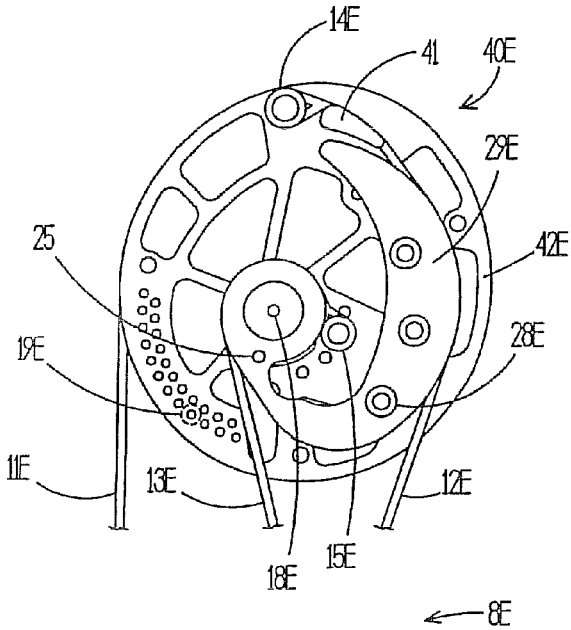
FIG. 8A is an elevational view of the back side of the top pulley in FIG. 8.
Figure 8A:
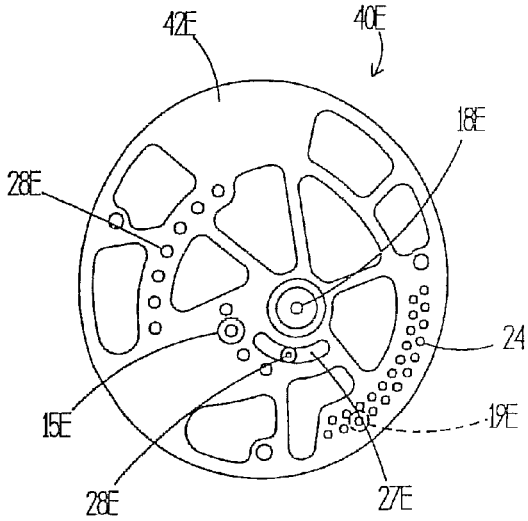
Figure 8:
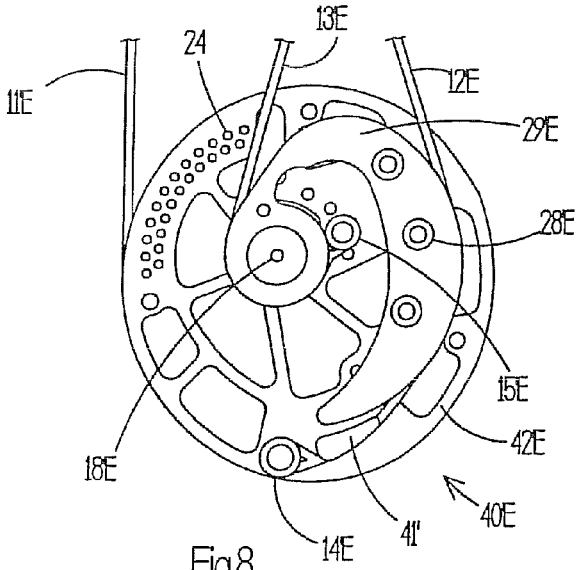
FIG. 8 is a fragmentary elevational view similar to those of FIGS. 2, 3, 4 and 5 but illustrating a further embodiment of the present disclosure.
Figure 8B:
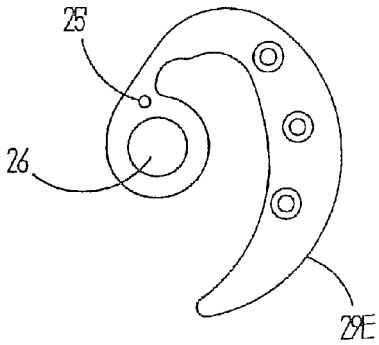
FIG. 8B is an elevational view of a replaceable draw module in the bow of FIG. 8.

FIGS. 8-8B illustrate a dual-cam bow 8E, in which the draw modules 29E,29'E of pulleys 40E,40'E have adjustably positionable draw length modules 29E,29'E rather than fixed-position draw length modules as in the prior embodiments. Bases 42E, 42'E of pulleys 40E, 40'E have threaded openings that receive screws 28E, 28'E for anchoring modules 29E, 29'E. Each module 29E, 29'E has an opening 26 that can be either concentric with or eccentric to the periphery of the module, and that encircles the associated axle 18E or 18'E so that the module can be adjustably pivoted around the axle to adjust bow draw length. A piece 41, 41' is affixed to each pulley base 42E, 42'E to guide cable ends 12E, 12'E from modules 29E, 29'E to anchors 14E, 14'E. Threaded openings 24 on bases 42E, 42'E provide for adjustable positioning of draw stops 19E.

Figure 9:
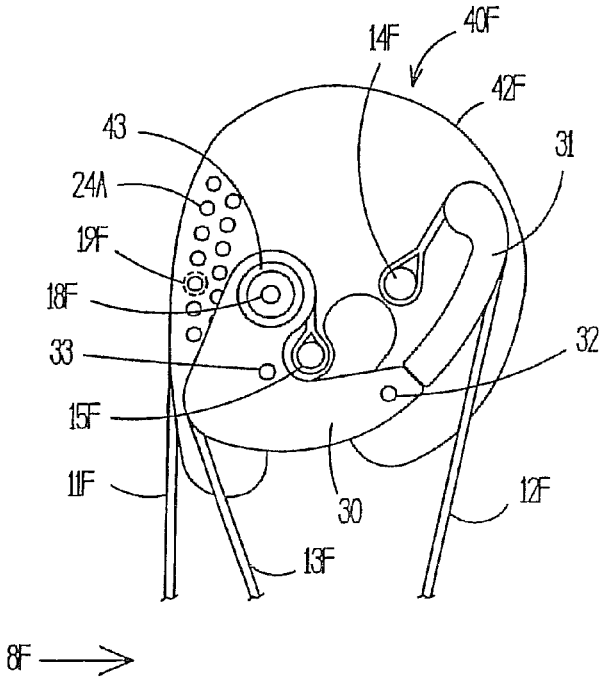
FIG. 9 is a fragmentary elevational view of a further embodiment of the present disclosure.
Figure 9:
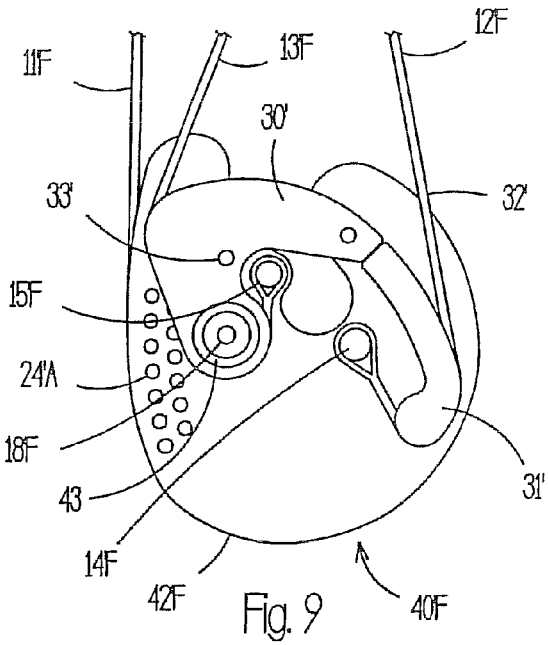
Figure 9A:
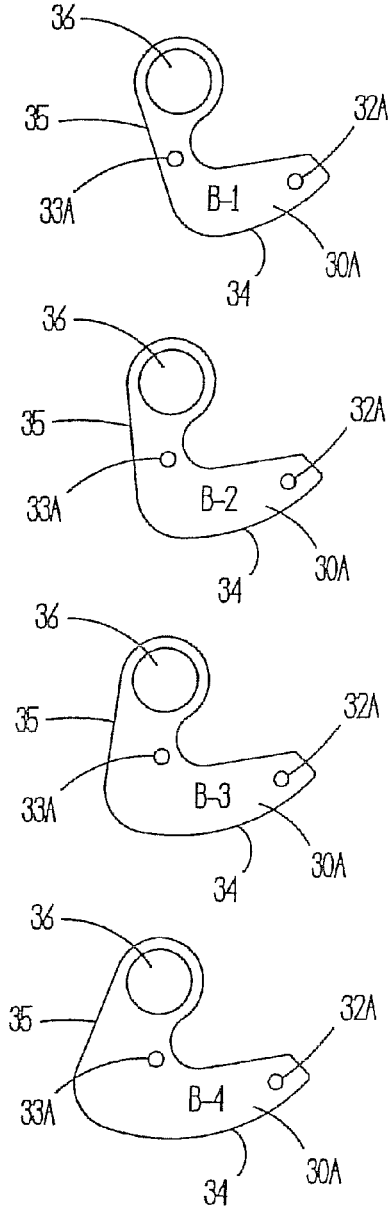
FIG. 9A is elevational views of replaceable draw length modules for the embodiment of FIG. 9.

FIG. 9 illustrates a dual-cam bow 8F. Pulleys 40F, 40'F have replaceable non-adjustable draw length modules 30, 30'. Each module has an opening 36 that embraces the associated axle 18F, 18'F or axle boss 43, 43'. Modules 30, 30' are secured in position by screws 32, 33 and 32', 33' threaded into openings 32A, 33A (FIG. 9A). Adjacent to module 30, 30' are sections 31, 31 respectively affixed to bases 42F, 42'F of pulleys 40F, 40'F. Sections 31, 31' have cable grooves that form respective extensions of the module cable grooves 34. Thus, in this embodiment, the let-out/take-up groove formed in each module 30, 31' is continued onto associated fixed section 31, 31'. In this embodiment, cable ends 12F,12'F initially are taken up into the grooves on sections 31,31' and then into the grooves on replaceable modules 30,30'. FIG. 9A illustrates a number of replaceable modules 30,30' for different bow draw lengths.

Figure 1A:
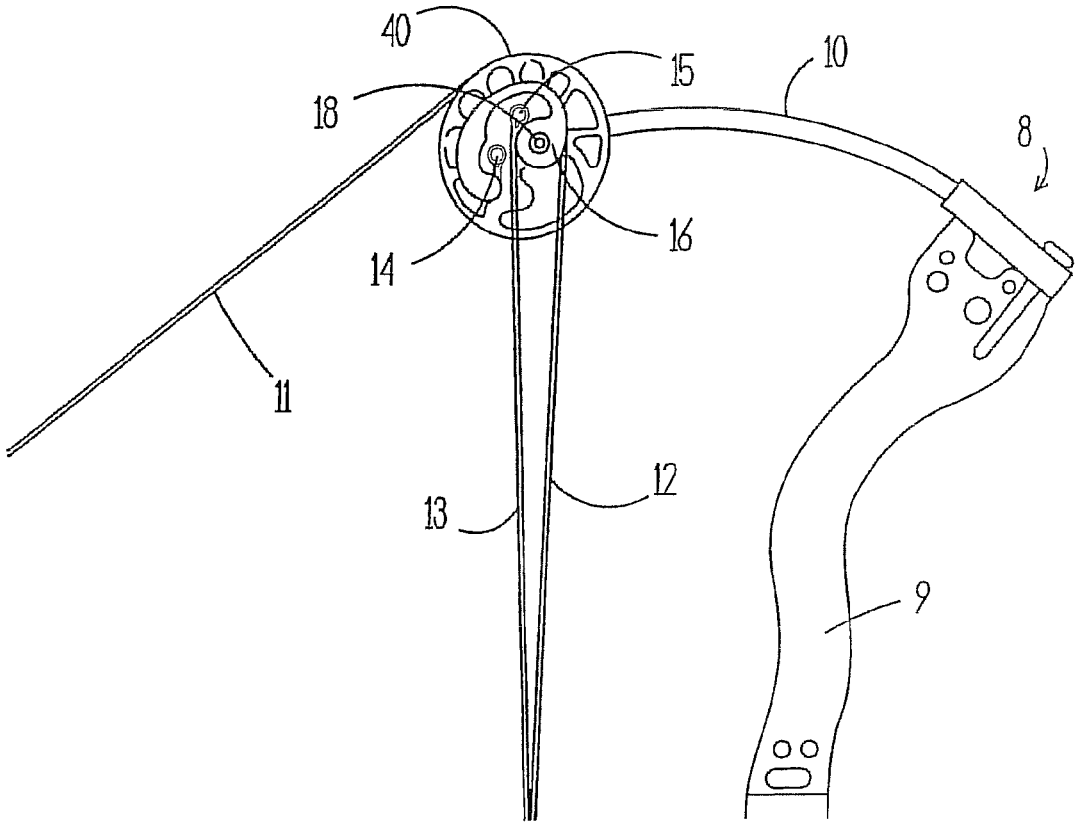
FIG. 1A is a fragmentary view of the upper portion of the bow in FIG. 1 with the bowstring fully drawn.
Figure 1B:
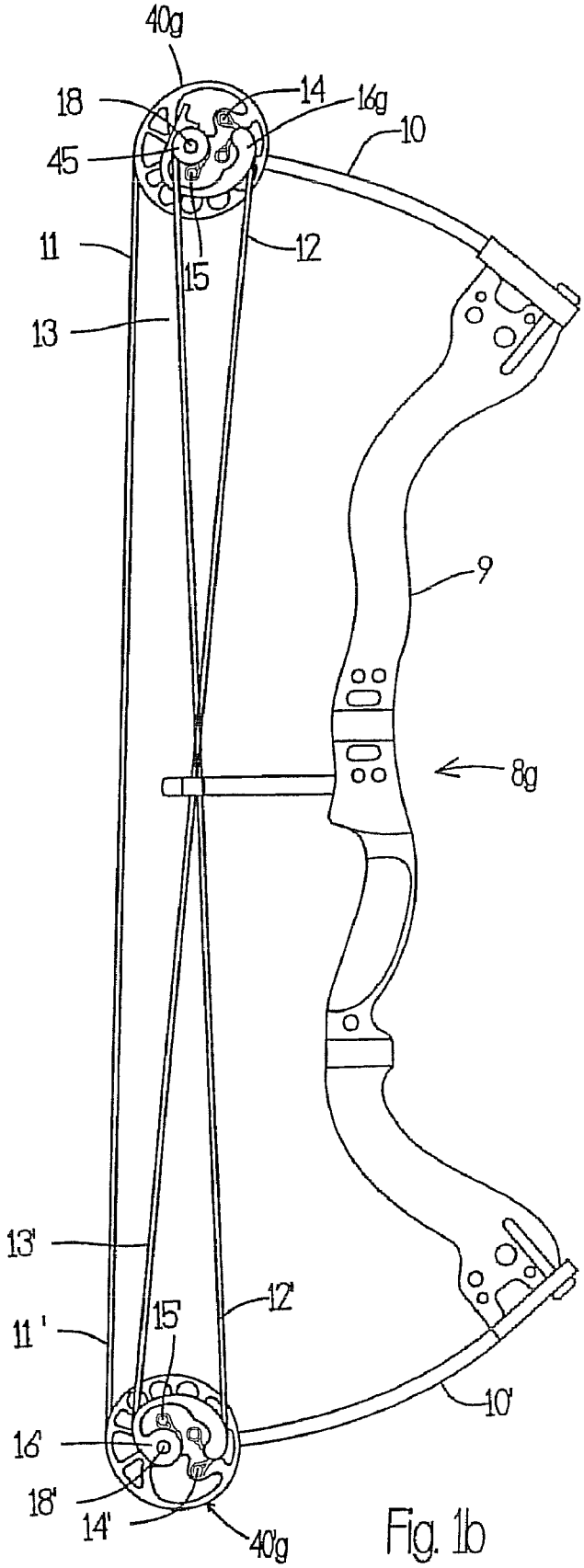
FIG. 1B is an elevational view of a modification to the embodiment of FIG. 1.

FIG. 1B illustrates a bow 8*g* in which lower pulley 40'*g* is the same as pulley 40' in FIGS. 1-2, but upper pulley 40*g* is modified. Pulley 40*g* in this embodiment preferably includes a module 16*g* with a groove for taking up cable end 12, and a pulley section 45 with a groove for letting out cable 13. Pulley 40*g* and pulley section 45 preferably are as disclosed in U.S. Pat. No. 6,996,970.

Figure 10A:
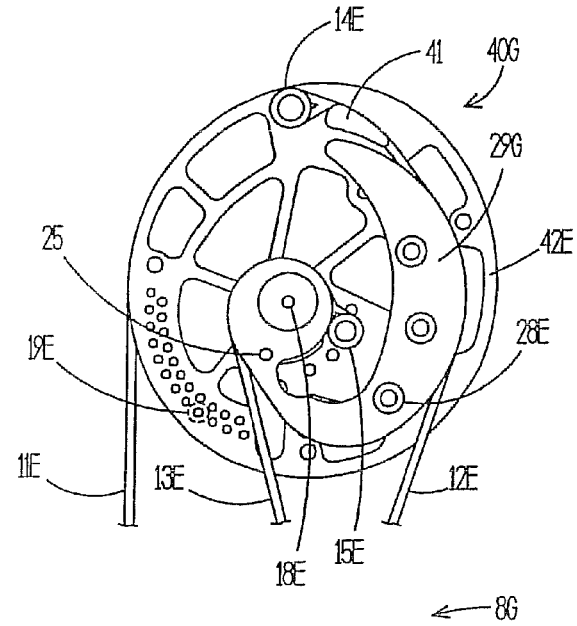
FIG. 10A is an elevational view of the base in the upper pulley of FIG. 10.
Figure 10A:
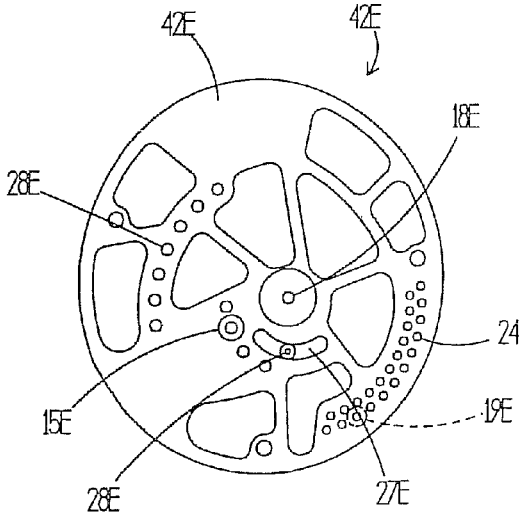
Figure 10:
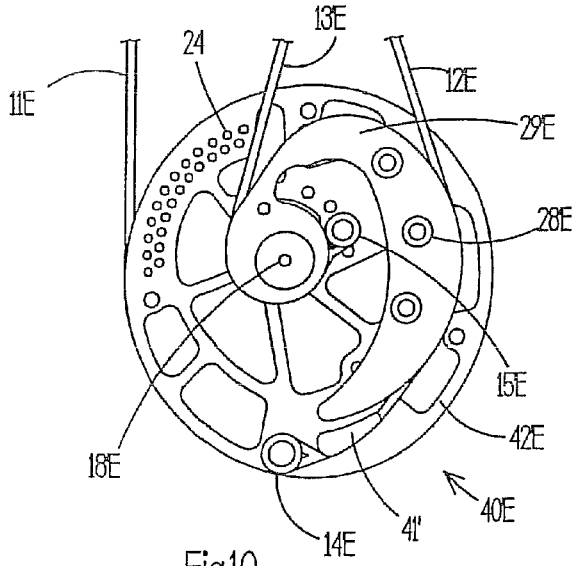
FIG. 10 is a fragmentary elevational view of a bow in accordance with a further embodiment of the disclosure.
Figure 10B:
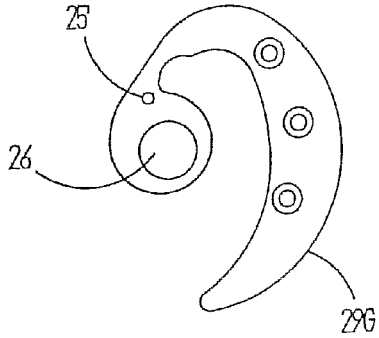
FIG. 10B is an elevational view of the draw length module in the upper pulley of FIG. 10.

FIGS. 10-10B illustrate a bow 8G that is very similar to the bow 8E of FIGS. 8-8B except that the opening 26G in the draw length module 29G is eccentric to the periphery of the module rather than concentric as in FIGS. 8-8B.

Adjustment of the bow draw lengths in the embodiments of FIGS. 1-7 and 9 requires replacement of the draw length modules, which in turn requires disassembly of each pulley from the bow because the modules are mounted on the pulley axles. In the embodiments of FIGS. 8 and 10, the draw length modules are adjustably pivotal around the axles so that draw lengths can be adjusted within a limited range without disassembly of the pulleys.

There thus has been disclosed a compound archery bow that fully satisfies all of the objects and aims previously set forth. The bow has been disclosed in conjunction with a number of exemplary embodiments. Modifications and variations readily will suggest themselves to persons of ordinary skill in the art in view of the foregoing description. The disclosure is intended to embrace all such modifications and variations as fall within the spirit and broad scope of the appended claims.

The invention claimed is:

1. A cam assembly comprising:

a bowstring cam component having a track for receiving a bowstring, and a power cable cam component having a take up portion and a let out portion, wherein the take up and let out portion each have a track for receiving a power cable, further comprising a draw stop pin.

2. A cam assembly comprising:

a bowstring cam component having a track for receiving a bowstring, and a power cable cam component having a take up portion and a let out portion, wherein the take up and let out portion each have a track for receiving a power cable, further comprising a second power cable cam assembly having a take up portion and a let out portion, wherein the take up and let out portion have a track for receiving a power cable, and wherein the tracks of the take up and let out portion of at least one of the power cable cam assemblies are connected as a continuous track around the perimeter of the power cable cam assembly.

3. A compound bow comprising:

a handle portion, a limb portion, at least two cam assemblies, each comprising:

a bowstring cam component having a track for receiving a bowstring, and a power cable cam component having a take up portion and a let out portion, wherein the take up and let out portions have a track for receiving a power cable, a draw stop pin, a take up terminating post, and a let out terminating post, an axle, at least two power cables, and a bowstring.

4. The compound bow of claim 3 wherein the cam assembly is placed on an axle on the limb portion of the bow, wherein one power cable is attached to a take up terminating post and wrapped around the take up portion of the power cable cam component on a first cam assembly and at its other end is attached to the let out terminating post and wrapped around the let out portion of the power cable cam component on the second cam assembly.

5. The compound bow of claim 4 wherein the second power cable is attached to the let out terminating post and is wrapped around the let out portion of the power cable component on the first cam assembly, and at its other end is attached to the take up terminating post and wrapped around the take up portion of the power cable cam component of the second cam assembly.

6. A compound bow comprising:

a handle portion, an upper limb portion having at least one upper cam assembly rotatably mounted thereon, a lower limb portion having at least one lower cam assembly rotatably mounted thereon, said upper cam assembly comprising:

a bowstring cam component having a track for receiving a bowstring, a power cable cam component having a take up portion and a let out portion, said take up portion having a track for receiving a power cable, said let out portion having a track for receiving a power cable, the tracks for the take up portion and let out portion being substantially coplanar, and said lower cam assembly comprising:

a bowstring cam component having a track for receiving a bowstring, a power cable cam component having a take up portion and a let out portion, said take up portion having a track for receiving a power cable, said let out portion having a track for receiving a power cable, the tracks for the take up portion and let out portion being substantially coplanar, further comprising:

a first power cable having a first and second end, a second power cable having a first and second, and a bowstring, wherein said first power cable is anchored to said upper cam assembly with a portion adjacent to the first end of said first power cable received in the track of said take up portion of said power cable cam component on said upper cam assembly, and the second end is anchored to said lower cam assembly with a portion adjacent to the second end of said first power cable received in the track of said let out portion of said power cable cam component on the lower cam assembly, wherein said second power cable is anchored to said upper cam assembly with a portion adjacent to the first end of said second power cable received in the track of said let out portion of said power cable cam component on said upper cam assembly and the second end is anchored to said power cam assembly with a portion adjacent to the second end of said second power cable cam received in the track of said take up portion of said power cable cam component on the lower cam assembly, such that the first end of said first power cable and the first end of said second power cable are coplanar, and the second end of said first power cable and the second end of said second power cable are coplanar.

7. A compound bow comprising:

a handle portion, an upper limb portion having at least one upper cam assembly rotatably mounted thereon, a lower limb portion having at least one lower cam assembly rotatably mounted thereon, said upper cam assembly comprising:

a bowstring cam component having a track for receiving a bowstring, a power cable cam component having a take up portion and a let out portion, said take up portion having a track for receiving a power cable, said let out portion having a track for receiving a power cable, the tracks for the take up portion and let out portion being substantially coplanar, and said lower cam assembly comprising:

a bowstring cam component having a track for receiving a bowstring, a power cable cam component having a take up portion and a let out portion, said take up portion having a track for receiving a power cable, said let out portion having a track for receiving a power cable, the tracks for the take up portion and let out portion being substantially coplanar, wherein the tracks on said take up portion and let out portion of said power cable cam component of said upper cam assembly are a continuous track around at least a portion on the periphery of said power cable cam assembly.

8. The compound bow of claim 7 wherein the tracks on said take up portion and said let out portion of said power cable cam component of said lower cam assembly are a continuous track around at least a portion on the periphery of said power cable cam assembly.

9. A compound bow comprising:

a handle portion, an upper limb portion having at least one upper cam assembly rotatably mounted thereon, a lower limb portion having at least one lower cam assembly rotatably mounted thereon, said upper cam assembly comprising:

a bowstring cam component having a track for receiving a bowstring, a power cable cam component having a take up portion and a let out portion, said take up portion having a track for receiving a power cable, said let out portion having a track for receiving a power cable, the tracks for the take up portion and let out portion being substantially coplanar, and said lower cam assembly comprising:

a bowstring cam component having a track for receiving a bowstring, a power cable cam component having a take up portion and a let out portion, said take up portion having a track for receiving a power cable, said let out portion having a track for receiving a power cable, the tracks for the take up portion and let out portion being substantially coplanar, wherein at least one of said upper or lower cam assemblies further comprises a draw stop pin.

10. A compound bow comprising:

a handle portion, a first power cable having a first and second end, a second power cable having a first and second end, a bowstring, an upper limb portion having at least one upper cam assembly rotatably mounted thereon, a lower limb portion having at least one lower cam assembly rotatably mounted thereon, said upper cam assembly comprising:

a bowstring cam component having a track for receiving a bowstring, a power cable cam component having a take up portion and a let out portion, a take up terminating post, and a let out terminating post, said take up portion having a track for receiving a power cable, said let out portion having a track for receiving a power cable, the tracks for the take up portion and let out portion being substantially coplanar, said lower cam assembly comprising:

a bowstring cam component having a track for receiving a bowstring, a power cable cam component having a take up portion and a let out portion, a take up terminating post, and a let out terminating post, said take up portion having a track for receiving a power cable, said let out portion having a track for receiving a power cable, the tracks for the take up portion and let out portion being substantially coplanar, wherein the first end of said first power cable is attached to said take up terminating post and wrapped around said take up portion of said power cable cam component on said upper cam assembly and the second end of said first power cable is attached to said let out terminating post and wrapped around the let out portion of said power cable cam component of said lower cam assembly, wherein the first end of said second power cable is attached to said let out terminating post and wrapped around said let out portion of said power cable cam component on said upper cam assembly and the second end of said second power cable is attached to said take up terminating post and wrapped around the take up portion of said power cable cam component of said lower cam assembly, such that the tracks in said take up portion and let out portion of said power cable cam component of said upper cam assembly are substantially coplanar.

11. The compound bow of claim 10 wherein the tracks on said take up portion and said let out portion of said power cable cam component of said upper cam assembly are a continuous track around at least a portion on the periphery of said power cable cam assembly.

12. The compound bow of claim 10 wherein the tracks on said take up portion and said let out portion of said power cable cam component of said lower cam assembly are a continuous track around at least a portion on the periphery of said power cable cam assembly.

13. The compound bow of claim 10 wherein the tracks on said take up portion and said let-our portion of the power cable cam component of either the upper or lower cam assembly are distinct non-continuous tracks on the periphery of said power cable cam assembly.

14. The compound bow of claim 10 wherein at least one of said let out portions of said power cable cam component of said upper or lower cams is a modular unit.

15. The compound bow of claim 14 wherein said let out portion is attached to a power cable cam component.

16. The compound bow of claim 10 wherein at least one of said upper or lower cam assemblies further comprises a draw stop pin.

17. A compound bow comprising:

a handle portion, two limb portions each having at least one cam assembly rotatably mounted on a limb, the cam assembly comprising:

a bowstring cam component having a track for receiving a bowstring, a power cable cam component having a take up portion and a let out portion, the take up portion and let out portion each comprise a track for receiving a power cable, the tracks for the take up portion and let out portion are substantially coplanar, further comprising:

two power cables, and a bowstring, wherein the first power cable is anchored to the first cam assembly with a portion adjacent to the first end sitting in the take up portion track of the power cable cam component on the first cam assembly and its second end is anchored to the second cam assembly with a portion adjacent to the second end sitting in the let out portion track of the power cable cam component on the second cam assembly, wherein the second power cable is anchored to the first cam assembly with a portion adjacent to the first end sitting in the let out portion track of the power cable cam component on the first cam assembly and its second end is anchored to the second cam assembly with a portion adjacent to the second end sitting in the take up portion track of the power cable cam component on the second cam assembly, such that the respective power cables while sitting in the tracks are coplanar.

18. A compound bow comprising:

a handle portion, two limb portions each having at least one cam assembly rotatably mounted on a limb, the cam assembly comprising:

a bowstring cam component having a track for receiving a bowstring, a power cable cam component having a take up portion and a let out portion, the take up portion and let out portion each comprise a track for receiving a power cable, the tracks for the take up portion and let out portion are substantially coplanar, wherein the tracks on said take up portion and the let out portion of the power cable cam assembly are part of a continuous track around at least a portion on the periphery of said power cable cam assembly.

* * * * *